US010926118B2

(12) United States Patent
Choi et al.

(10) Patent No.: US 10,926,118 B2
(45) Date of Patent: Feb. 23, 2021

(54) SAFETY HANDLE OF FIRE EXTINGUISHER AND FIRE EXTINGUISHER HAVING THE SAFETY HANDLE

(71) Applicant: TOP ENGINEERING AND CONSTRUCTION CO., LTD., Gumi-si (KR)

(72) Inventors: Hojae Choi, Daegu (KR); Seungwook Han, Gumi-si (KR); Kooksang Sim, Gumi-si (KR); Seongdae Choi, Gumi-si (KR); Seog Chae, Gumi-si (KR)

(73) Assignee: TOP ENGINEERING AND CONSTRUCTION CO., LTD., Gumi-si (KR)

( * ) Notice: Subject to any disclaimer, the term of this patent is extended or adjusted under 35 U.S.C. 154(b) by 0 days.

(21) Appl. No.: 15/781,376

(22) PCT Filed: May 24, 2016

(86) PCT No.: PCT/KR2016/005462
§ 371 (c)(1),
(2) Date: Jun. 4, 2018

(87) PCT Pub. No.: WO2017/131294
PCT Pub. Date: Aug. 3, 2017

(65) Prior Publication Data

US 2019/0001168 A1 Jan. 3, 2019

(30) Foreign Application Priority Data

Jan. 31, 2016 (KR) ..... 10-2016-0012049

(51) Int. Cl.
*A62C 13/64* (2006.01)
*A62C 13/76* (2006.01)
*A62C 31/02* (2006.01)

(52) U.S. Cl.
CPC ..... *A62C 13/64* (2013.01); *A62C 13/76* (2013.01); *A62C 31/02* (2013.01)

(58) Field of Classification Search
CPC ..... A62C 13/64; A62C 13/76; A62C 31/02
(Continued)

(56) References Cited

U.S. PATENT DOCUMENTS 2,541,073 A * 2/1951 Kaufman ..... A62C 13/003 169/75
2,736,919 A * 3/1956 Nurkiewicz ..... A62C 13/003 16/110.1
(Continued)

FOREIGN PATENT DOCUMENTS

KR 20-2002-0003363 Y1 4/2002
KR 20-0274902 Y1 5/2002
(Continued)

*Primary Examiner* — Chee-Chong Lee
(74) *Attorney, Agent, or Firm* — Maschoff Brennan

(57) ABSTRACT

A safety handle of a fire extinguisher includes a lower handle coupled to an upper end of a valve and having a first hinge shaft at one end thereof and a first support shaft parallel to the first hinge shaft at a point spaced from the first hinge shaft. An upper handle is coupled to the lower handle to be rotatable around the first hinge shaft and downwardly rotate around the first hinge shaft to push an open pin of the fire extinguisher. A second support shaft is parallel to the first hinge shaft at one point. A safety pin prevents the upper handle from rotating. A first link having a first end of a length direction is coupled to the first support shaft to be rotatable around the first support shaft. A second link having a first end of a length direction is coupled to the second support shaft.

6 Claims, 4 Drawing Sheets

(58) Field of Classification Search
USPC ..... 169/89
See application file for complete search history.

(56) References Cited

U.S. PATENT DOCUMENTS

| | | | | | |
|---|---|---|---|---|---|
| 3,643,691 | A * | 2/1972 | Huthsing, Jr. | A62C 13/003 | 137/590 |
| 4,684,037 | A * | 8/1987 | Gnutti | F16K 31/5284 | 222/3 |
| 5,816,331 | A * | 10/1998 | Vivier | A62C 13/76 | 169/30 |
| 6,378,618 | B1 * | 4/2002 | Yang | A62C 13/76 | 169/74 |

FOREIGN PATENT DOCUMENTS

| | | | |
|---|---|---|---|
| KR | 10-2002-0015090 | Y1 | 9/2002 |
| KR | 20-0288994 | Y1 | 9/2002 |
| KR | 10-1444688 | B1 | 9/2014 |
| KR | 10-1524645 | B1 | 6/2015 |
| KR | 10-1533302 | B1 | 7/2015 |

* cited by examiner

SAFETY HANDLE OF FIRE EXTINGUISHER AND FIRE EXTINGUISHER HAVING THE SAFETY HANDLE

The present invention relates to a fire extinguisher and a safety handle thereof and more particularly, to a safety handle with a configuration in which when a fire extinguisher is used to extinguish a fire, the safety pin coupled to the safety handle of the fire extinguisher may be easily separated.

RELATED ART

A fire extinguisher is used to extinguish a fire at its initial stage and has a structure in which fire extinguishing agents accommodated in the fire extinguisher gush.

With reference to FIG. 1, the structure and operation of a conventional fire extinguisher will be described.

A conventional fire extinguisher is filled with fire extinguishing agents in the main body 10. The fire extinguishing agents filling the main body 10 are discharged through a discharge pipe 11 arranged in the main body 10 and sprayed through a hose 12 at the place where there is a fire.

Further, a valve 13 is installed between the discharge pipe 11 and the hose 12 to open and close the discharge pipe 11, an opening pin 14 is installed at the upper side of the valve 13 such that the valve 13 is opened to discharge the fire extinguishing agents from the discharge pipe 11 to the hose 12 when the opening pin 14 is pressed.

A safety handle 20 is coupled to the upper side of the valve and consists of a lower handle 21 fixed to the upper side of the valve 13 and an upper handle 22 swivably coupled around a hinge shaft 23 fixed to the lower handle 21.

The opening pin 14 penetrates into the lower handle 21 to extend towards the upper handle 22, and when the upper handle 22 is pressed towards the lower handle 21, the upper handle 22 presses the opening pin 14 such that the valve 13 is opened to gush the fire extinguishing agents.

Meanwhile, each of the upper 22 and lower 21 handles has a through hole in parallel with the hinge shaft 23. The through holes are formed at a position where the upper handle 22 does not press the opening pin 14, that is, a position where the through holes are formed at a position where a path into which the thorough holes penetrate into each other is formed, in the state where the through holes are placed at the upper side, and a safety pin 24 is inserted into the through holes.

Accordingly, even when the upper handle 22 is pressed in the state where the safety pin 24 is inserted, the upper handle 22 does not rotate with respect to the hinge shaft 23 and the opening pin 14 is not pressed. However, when the fire extinguisher is used to extinguish a fire, the safety pin 14 is pulled and removed, the upper handle 22 is pressed, the upper handle 22 presses the opening pin 14 and then, the valve 13 is opened to gush the fire extinguishing agents.

Such a safety pin prevents the upper handle of the fire extinguisher from being pressed by accident and prevents the fire extinguishing agents from gushing without intention when the fire extinguisher is not used. When the fire extinguisher is used, the safety pin 24 is pulled and removed from the safety handle 20, and afterwards, the upper handle 22 is pressed downwards so as to gush the fire extinguishing agents from the fire extinguisher.

People learn how to use the fire extinguisher during fire drills conducted by schools and the relevant authorities. However, despite this, there are still may people who do not how to use the fire extinguisher. In particular, people are often bewildered and confused about how to use the fire extinguisher and finally cannot use the fire extinguisher in an emergency such as a fire.

In particular, those who are not well-informed about a method of using the fire extinguisher bring the fire extinguisher to a place where there is a fire and often attempt to pull the safety pin in the state where they strongly grip the safety handle.

When the safety handle 20 is strongly gripped, the upper handle 22 is pressed towards the lower handle 21, and the safety pin 24 receives a strong shearing force from the through holes of the safety handle. Due to the shearing force, the safety pin 24 is not pulled from the through holes even when the safety pin 24 is strongly pulled.

DETAILED DESCRIPTION OF THE INVENTION

Technical Problems

As a means to solve the above-described problems with a fire extinguisher having a conventional structure, provided is a safety handle and a fire extinguisher having the same according to the present invention which has the structure in which the safety pin is easily removed even in the state where the safety handle is strongly gripped and the upper handle is strongly pressed towards the lower handle.

Technical Solutions

The above-described problems can be solved by using the present invention in relation to a safety handle of a fire extinguisher and a fire extinguisher having a safety handle.

The present invention relates to a main body having a gushing mouth for spraying fire extinguishing agents arranged at the upper with which fire extinguishing agents are filled, a valve arranged at the upper portion of the main body for opening and closing the gushing mouth, an open pin arranged at the upper side of the valve for opening the valve by means of pressing, and a safety handle coupled to the upper end of the valve, in which when the safety handle is pressed, the open pin is pressed such that the fire extinguishing agents in the main body gush, and in the state in which a safety pin installed between an upper handle and a lower handle is not removed, the safety handle is not pressed because of the safety pin.

A safety handle of a fire extinguisher according to the present invention comprises a lower handle which is coupled to the upper end of a valve and has a first hinge shaft at one end thereof and a first support shaft parallel to the first hinge shaft at a point spaced apart from the first hinge shaft; an upper handle which is coupled to the lower handle so as to swivel around the first hinge shaft, swivels downwards around the first hinge shaft so as to push the open pin, and is provided with a second support shaft parallel to the first hinge shaft at one point; a safety pin for preventing the upper handle from swiveling; a first link having a first end in the length direction thereof coupled to the first support shaft so as to swivel around the first support shaft; a second link having a first end in the length direction thereof coupled to the second support shaft so as to swivel around the second support shaft; and a second hinge shaft to which a second end at the opposite side of the first end of the first link, and a second end at the opposite side of the first end of the second link are swivably coupled, wherein through-holes are formed in each of the upper handle, the lower handle, and the second hinge shaft, the through-holes are disposed at the same point in the state where the upper handle does not swivel downwards, and the safety pin is inserted into the through-holes.

First, the operation of a safety handle and a fire extinguisher having the same of the present invention with the above-described configuration will be described.

The upper handle may swivel around the first hinge shaft with respect to the lower handle. When the upper handle is pressed, the upper handle presses an open pin to open a valve such that fire extinguisher agents gush out of the main body of a fire extinguisher.

However, the safety handle of the present invention has a configuration in which the upper handle is selectively swiveled or prevented from swiveling, and includes a linkage device and a safety pin.

The first link is swivably coupled to the upper handle, and the second link is swivably coupled to the lower handle. Because the first and second links are swivably coupled to each other by a second hinge shaft, when the upper handle is pressed, the upper handle swivels around the first hinge shaft downwards. In this case, the first and second links rotates in opposite directions to each other, and the second hinge shaft moves in the direction of the first hinge shaft or in the opposite direction of the first hinge shaft.

Through-holes are formed at the upper handle, the lower handle, and the second hinge shaft, and the safety pin is inserted into the through-holes. In the state where the safety pin is inserted, the second hinge shaft is prevented from moving so as to prevent the first and second links from rotating such that the upper handle is not pushed.

In the state where the safety pin is removed, when the upper handle is pushed, a linkage device consisting of the first link, the second link and the second hinge shaft does not interfere with the operation of the upper handle.

Meanwhile, in terms of a fire extinguisher, the upper handle is pushed to open the valve in the state where the safety pin is removed. However, if the user does not know how to use such a fire extinguisher or if the user is bewildered because of a fire, the user might attempt to remove the safety pin in the state where the user is gripping the safety handle, that is, in the state where the upper handle is pressed against the lower handle.

In terms of the safety handle of the present invention, the pressing force acting on the upper handle is delivered to the lower handle through the first link, the second hinge shaft and the second link, and only frictional force between the safety pin and inner surfaces of the through-holes of the second hinge shaft and the upper and lower handles acts on the safety pin by means of the component of force of the pressing force acting on the upper handle.

Such a component of force is a value obtained by multiplying a value of force (F) acting on the first support shaft by means of the upper handle by a sine value of an angle (θ) formed by the straight line connecting the first and the second support shafts and the straight line connecting the second support shaft and the second hinge shaft. Accordingly, the component of force is much smaller than force (F) acting on the first support shaft by means of the upper handle.

As a result, in terms of the safety handle of the present invention, even when the safety pin is removed in the state where the upper handle is pressed, it takes a small amount of force to remove the safety pin.

In particular, if the second hinge shaft is arranged close to the straight line connecting the first support shaft and the second support shaft, the angle (θ) is very small. Accordingly, the component of force acting on the safety pin becomes smaller depending on the force actin on the upper handle such that the safety pin is more easily removed.

Advantageous Effects

According to the configuration and operation of the present invention, even if the user does not know how to use the fire extinguisher or if the user is bewildered because of a fire, the user can easily remove the safety pin from the safety handle to gush the fire extinguishing agents even in the state where the user is gripping the safety handle and the upper handle is pressed.

BRIEF DESCRIPTION OF THE INVENTION

BEST MODE FOR CARRYING OUT THE INVENTION

The configuration and operation of a fire extinguisher according to preferred embodiments of the preset invention will be described hereunder with reference to the attached drawings.

Figure 1:
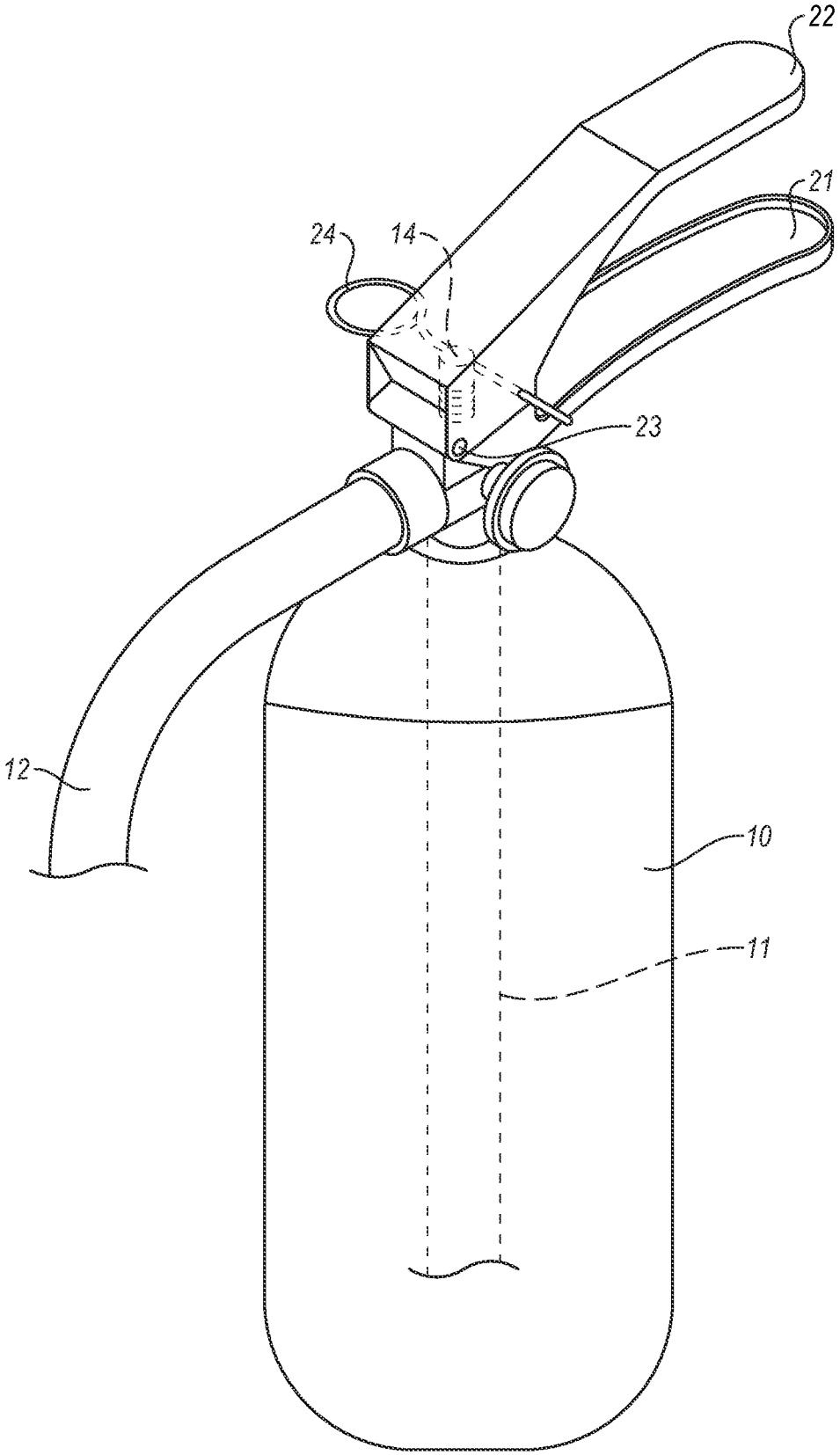
FIG. 1 is a perspective view illustrating a configuration of a usual fire extinguisher.

A fire extinguisher according to this embodiment and the conventional fire extinguisher illustrated in FIG. 1 are the same except a safety handle. Accordingly, separate descriptions and illustrations of the main body 10 and valve 13 of the fire extinguisher according to this embodiment will be omitted.

Like safety handles of fire extinguishers according to related arts, a safety handle 30 according to this embodiment basically includes a lower handle 31 which is attached to the upper end of a valve 13, into which an open pin 14 penetrates, and from which the open pin protrudes, and an upper handle 32 which is swivably coupled to the lower handle 31 by means of a first hinge shaft 33.

Figure 2A:
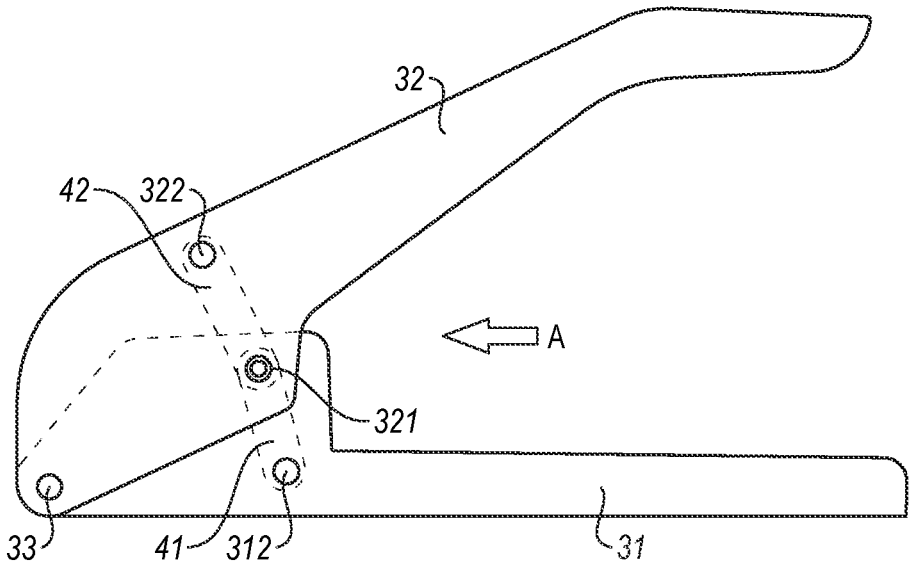
FIGS. 2A and 2B are side views illustrating a safety handle of a fire extinguisher according to an embodiment of the present invention.
Figure 4:
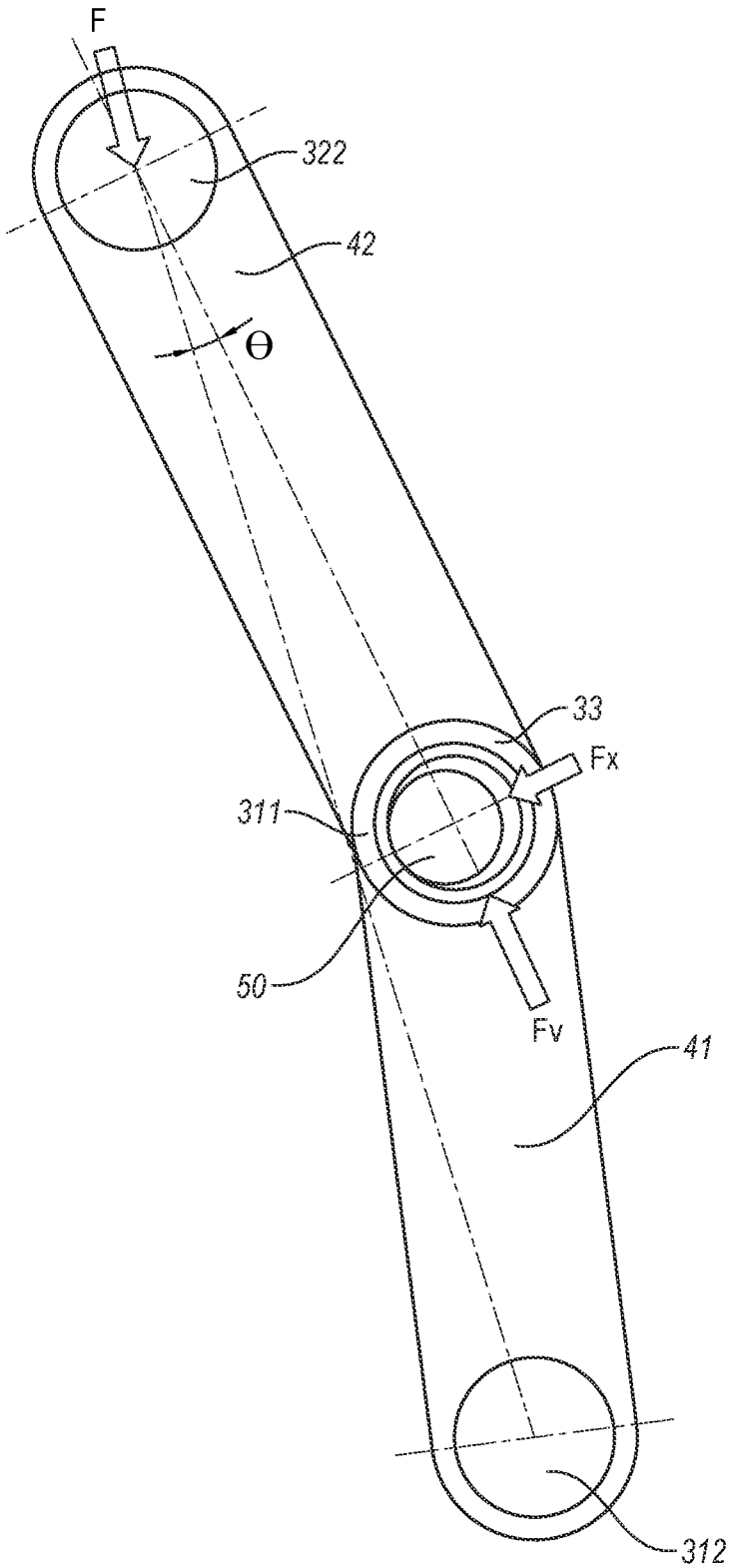
FIG. 4 is a view illustrating the operation of a linkage device of a safety handle of a fire extinguisher according to an embodiment of the present invention.

The detailed configuration and operation of a safety handle 30 according to this embodiment will be described with reference to FIGS. 2A and 4. In FIGS. 2A and 4, illustrations of other configurations such as a main body 10, a valve 13 and an open pin 14 etc. of the fire extinguisher except a safety handle will be omitted for convenience's sake.

A safety handle 30 according to this embodiment includes a lower handle 31 which is fixed to the upper side of the valve (13 in FIG. 1) and has a channel-shaped cross section, a first hinge shaft 33 which is provided at the end fixed to the upper end of the valve in the lower handle 31, and an upper handle 32 whose one end is swivably coupled to a first hinge shaft 33 so as to swivel with respect to the lower handle 31 around the first hinge shaft 33 and which has the same channel-shaped cross section as the lower handle 31 to extend. The first hinge shaft 33 is arranged across the channel-shaped cross sections of the upper handle 32 and lower handle 31.

Figure 3:
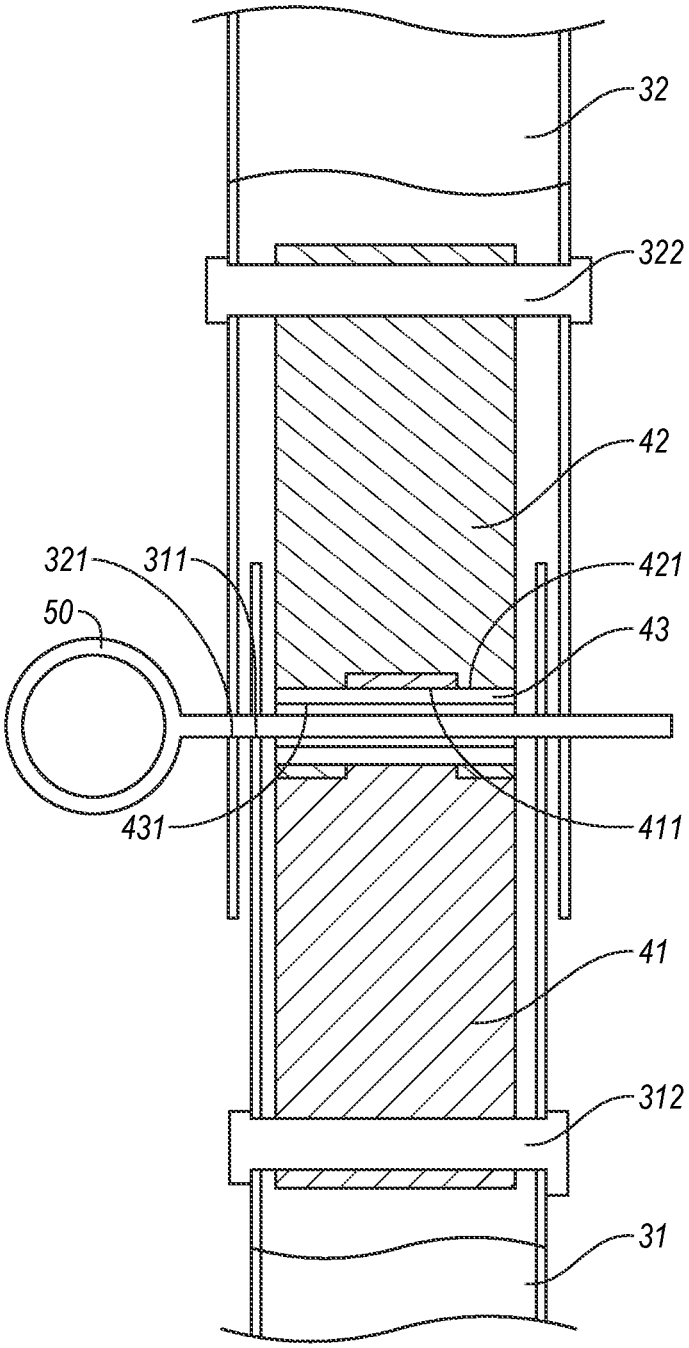
FIG. 3 is a view illustrating a safety handle of a fire extinguisher according to an embodiment of the present invention seen in the direction of the arrow of A in FIG. 2A.

With reference to FIG. 3, the upper handle 32 has through holes 321 penetrating both side walls of the channel and formed at a point spaced apart from the first hinge shaft 33, and the lower handle 31 also has through holes 311 penetrating both side walls of the channel and formed at a point placed the same distance apart from the first hinge shaft 33 as the through-holes 421 of the upper handle.

Meanwhile, the lower handle 31 has a first support shaft 312 installed between both side walls of the channel at a lower side in the direction where the lower handle 31 swivels with respect to the through holes 311 while the upper handle 32 has a second support shaft 322 installed between both side walls of the channel at an upper side in the direction where the upper handle 32 swivels with respect to the through holes 321.

A first link 41 is swivably coupled to the first support shaft 312 of the lower handle 31, and in detail, a through opening 411 is formed at the end of the first link 41, and the first support shaft 312 is inserted into the through opening 411.

A second link 42 is swivably coupled to the second support shaft 322 of the upper handle 32, and in detail, a through opening 421 is formed at the end of the second link 42, and the second support shaft 322 is inserted into the through opening 421.

A protrusion part 412 is formed at the end at the opposite side of the first support shaft 312 at the first link 41 at both sides in a lateral direction, and a through opening 413 is formed at the protrusion part 412. A protrusion part 422 is formed at the end at the opposite side of the second support shaft 322 at the second link 42 at the center in a lateral direction, and a through opening 423 is also formed at the protrusion part 422.

The protrusion parts 412 of the first link and the protrusion part 422 of the second link are arranged to be complementary to each other. Accordingly, the protrusion parts 412 of the first link and the protrusion part 422 of the second link are placed in parallel with each other as illustrated in FIG. 3.

The second hinge shaft 43 is inserted into the protrusion parts 412 of the first link and the protrusion part 422 of the second link such that each end of one side of the first link 41 and the second link 42 is swivably coupled to the lower handle 31 and the upper handle 32, and the ends of the other side of the first link 41 and the second link 42 are swivably coupled to each other such that the first link 41 and the second link 42 rotate with respect to each other.

The second hinge shaft 43 has a through hole 431 penetrating both ends of the second hinge shaft in the length direction thereof.

In a non-operating state illustrated in FIG. 2A, that is, in the state where the upper handle 32 is not pressed, the through holes 311, 321 of the lower handle 31 and the upper handle 32 are placed at the same point while the through hole 431 of the second hinge shaft 43 is placed at the same point as the through holes 311, 321, of the upper and lower handles. As described, the through holes 311, 321, 431 are in parallel with one another, and a safety pin 50 is inserted into the through holes as illustrated in FIG. 3.

Figure 2B:
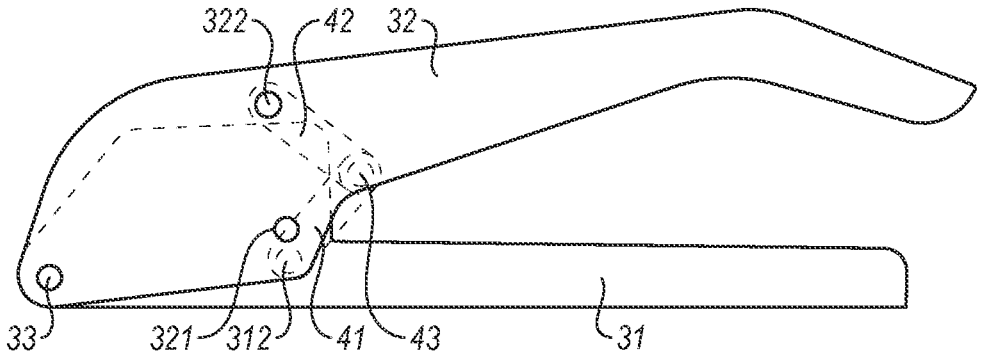

First, the operation of a safety handle will be described with reference to FIG. 2B in the state where a safety pin 50 is removed from a safety handle 30 of this embodiment, that is, in the state where fire extinguishing agents are sprayed.

When the upper handle 32 is pressed to gush fire extinguishing agents, the second support shaft 322 is pressed. Then, the compressive pressure is consecutively delivered to the second link 42, the second hinge shaft 43 and the first link 41.

By means of the delivered compressive pressure, the first link 41 and the second link 42 rotate in the opposite direction, the second hinge shaft 43 moves toward a position determined by the ends of the rotating first link 41 and second link 42, that is, moves in a direction where the second hinge shaft 43 moves far away from the first hinge shaft 33.

As described above, when the user presses the upper handle 32 of the safety handle 30 to operate the fire extinguisher, a linkage device consisting of the first link 41, the second link 42 and the second hinge shaft 43 put no obstacle to the operation of the safety handle.

In the non-operating state of the fire extinguisher, the safety pin 50 is inserted into the through holes 311, 321 of the upper and lower handles and the through hole 431 of the second hinge shaft.

As described above, when the upper handle 32 is pressed in the state where the safety pin 50 is inserted, the second support shaft 322 is pressed, and then, the compressive pressure is consecutively delivered to the second link 42, the second hinge shaft 43 and the first link 41. However, because the safety pin 50 is inserted into the through holes 311, 321 of the upper and lower handles, the second hinge shaft 43 may not move. Accordingly, the first link 41 and the second link may not swivel. Therefore, the upper handle 32 may not swivel downwards.

By means of the above-described operation, in the state where the safety pin 50 is inserted, the upper handle 32 is not pressed. Accordingly, the safety handle remains in the non-operation state because of the safety pin 50.

Meanwhile, in this embodiment, even in the state where the upper handle 32 is strongly pressed towards the lower handle 31, the safety pin 50 may be easily removed when being strongly gripped. The operation theory will be described below.

In this embodiment, the center of the second hinge shaft 43 is arranged out of the line connecting the centers of the first support shaft 312 and the second support shaft 322, which serve as a center of the swivel movement of the first link 41 and the second link 42.

When the second hinge shaft 43 is put on the straight line connecting the first support shaft 312 and the second support shaft 322, the second link 42 and the first link 41 form a straight line with respect to each other. In this state, when the safety pin 50 is removed and the upper handle 32 is pressed, the compressive pressure is delivered through the second link 42 and the first link 41 to the lower handle 31, and there is the possibility that the upper handle cannot rotate with respect to the first hinge shaft 33 while the state where the first link 41 and the second link 42 do not rotate is maintained.

However, this does not happen to the safe handle of this embodiment because the second hinge shaft 43 is arranged out of the straight line connecting the first support shaft 312 and the second support shaft 322.

Due to the arrangement of the second hinge shaft, the component of force (Fx) with respect to the force (F) acting on the upper handle 32 causes frictional force which interferes with the removal of the safety pin 50.

FIG. 4 illustrates only the first support shaft 312, the first link 41, the second hinge shaft 43, the safety pin 50, the second link 42 and the second support shaft 322 and illustrates the state in which compressive force (F) acts on the second support shaft 322 when the upper handle 32 is pressed.

Force (F) applied to the second support shaft 322 acts in the direction of the straight line connecting the centers of the second support shaft 322 and the first support shaft 312. Such force (F) is the total force of the component of force (Fy) in the length direction of the second link 42 at the second hinge shaft 43 through the second link 42 and the component of force (Fx) in a direction perpendicular to the component of force (Fy).

By means of the component of force (Fx), the second hinge shaft 43 is inclined towards a direction perpendicular to the length direction of the second link 42. Because of this, the safety pin 50 inserted into the through hole 431 of the second hinge shaft 43 is also inclined by the second hinge shaft 43 and is pressed towards the edges of the through holes 311, 321 of the upper and lower handles, and when the safety pin 50 is removed from the through holes 311, 321, 431, frictional force is caused, which interferes with the removal of the safety pin 50.

The component of force (Fx) in a perpendicular direction acting on the safety pin 50 by means of the compressive force (F) is described by the following formula.

$$Fx=\sin(\theta)\times F$$

Herein, the angle "θ" is formed by the straight line, connecting the first support shaft 312 and the second support shaft 322, and the straight line connecting the second support shaft 322 and the second hinge shaft 43—i.e. the length direction of the second link 42.

In this embodiment, the center of the second hinge shaft 43 is arranged out of the straight line connecting the centers of the first support shaft 312 and the second support shaft 322. Although the angle "θ" is not 0°, the angle "θ" is very small enough to arrange the second hinge shaft 43 slightly out of the straight line connecting the centers of the first support shaft 312 and the second support shaft 322.

Accordingly, the component of force (Fx) in a perpendicular direction acting on the safety pin 50 is very small depending on force (F) pressed against the upper handle 32, and frictional force acting on the safety pin is very small by means of the component of force (Fx), thereby making it possible to easily remove the safety pin in the state where the upper handle is pressed according to the safety handle of this embodiment.

The invention claimed is:

1. A safety handle of a fire extinguisher which includes a main body with which fire extinguishing agents are filled and which has a gushing mouth formed at an upper end of a main body for gushing fire extinguishing agents, a valve arranged at the upper end of the main body for opening and closing the gushing mouth, and an open pin arranged at an upper side of the valve for opening the valve by means of pressing, the safety handle comprising:

a lower handle which is coupled to the upper end of the valve and has a first hinge shaft at one end thereof and a first support shaft parallel to the first hinge shaft at a point spaced apart from the first hinge shaft;

an upper handle which is coupled to the lower handle so as to swivel around the first hinge shaft, swivels downwards around the first hinge shaft so as to press the open pin, and is provided with a second support shaft parallel to the first hinge shaft at one point;

a safety pin for preventing the upper handle from swiveling;

a first link having a first end in the length direction thereof coupled to the first support shaft so as to swivel around the first support shaft;

a second link having a first end in the length direction thereof coupled to the second support shaft so as to swivel around the second support shaft; and a second hinge shaft to which a second end at the opposite side of the first end of the first link, and a second end at the opposite side of the first end of the second link are swivably coupled, wherein the upper handle has first through hole penetrating both side walls of a channel of the upper handle and formed at a point spaced apart from the first hinge shaft, the lower handle has second through hole penetrating both side walls of a channel of the lower handle and formed at a point placed a same distance apart from the first hinge shaft as a fourth through-holes of the upper handle, and the second hinge shaft has a third through hole and wherein the first, second and third through-holes are disposed at a same point in a state where the upper handle does not swivel downwards, and the safety pin is inserted into the first, second and third through-holes.

2. The safety handle according to claim 1, wherein the second hinge shaft is arranged out of the straight line connecting the first support shaft and second support shaft.

3. The safety handle according to claim 1, wherein the second hinge shaft has an external diameter larger than a diameter of the through-holes of the upper handle and lower handle.

4. A fire extinguisher comprising a main body having a gushing mouth for gushing fire extinguishing agents arranged at an upper end thereof with which the fire extinguishing agents are filled, a valve arranged at the upper portion of the main body for opening and closing the gushing mouth, an open pin arranged at the upper side of the valve for opening the valve by means of pressing, and a safety handle according to claim 1.

5. A fire extinguisher comprising a main body having a gushing mouth for gushing fire extinguishing agents arranged at an upper end thereof with which the fire extinguishing agents are filled, a valve arranged at the upper portion of the main body for opening and closing the gushing mouth, an open pin arranged at the upper side of the valve for opening the valve by means of pressing, and a safety handle according to claim 2.

6. A fire extinguisher comprising a main body having a gushing mouth for gushing fire extinguishing agents arranged at the upper end thereof with which the fire extinguishing agents are filled, a valve arranged at the upper portion of the main body for opening and closing the gushing mouth, an open pin arranged at the upper side of the valve for opening the valve by means of pressing, and a safety handle according to claim 3.

* * * * *